United States Patent [19]

Ohm

[11] 4,236,161

[45] Nov. 25, 1980

[54] ARRAY FEED FOR OFFSET SATELLITE ANTENNA

[75] Inventor: Edward A. Ohm, Holmdel, N.J.

[73] Assignee: Bell Telephone Laboratories, Incorporated, Murray Hill, N.J.

[21] Appl. No.: 943,064

[22] Filed: Sep. 18, 1978

[51] Int. Cl.[2] ..... H01Q 1/28

[52] U.S. Cl. ..... 343/781 CA; 343/100 ST; 343/DIG. 2

[58] Field of Search ..... 343/DIG. 2, 778, 779, 343/854, 781 CA, 100 ST

[56] References Cited

U.S. PATENT DOCUMENTS

| | | | |
|---|---|---|---|
| Re. 28,217 | 10/1974 | Malech | 343/778 |
| 3,295,134 | 12/1966 | Lowe | 343/854 |
| 3,406,401 | 10/1968 | Tillotson | 343/779 |
| 3,518,695 | 6/1970 | Schroeder | 343/854 |
| 3,541,553 | 4/1971 | Gubin | 343/100 ST |
| 3,569,976 | 3/1971 | Korvin et al. | 343/854 |
| 3,713,163 | 1/1973 | Keller et al. | 343/754 |
| 3,815,140 | 6/1974 | Buehler | 343/779 |
| 3,914,768 | 10/1975 | Ohm | 343/779 |
| 4,090,203 | 5/1978 | Duncan | 343/778 |

OTHER PUBLICATIONS

Hannan; Microwave Antennas Derived From the Cassegrain Telescope; PGAP Mar. 1961, pp. 140–153.

Kogelnik & Li; Laser Beams and Resonators; Applied Optics; Oct. 1966, pp. 1550–1567.

Duncan; Multiple Beam Antennas for Communication Satellites; Eascon 75 Record; 10-1-75, pp. 24A–24G.

Duncan et al; Dual Polarization Multiple Beam Antenna for Frequency Reuse Satellites; AIAA/CASI 6th Communications Satellite Systems Conference, Montreal, Canada, Apr. 5–8, 1976, Paper No. 76-248.

Scott et al; Design Tradeoffs for Multibeam Antennas in Communication Satellites; Conference Record, 1976 Int. Conf. on Communications, vol. I, Jun. 4–16, 1976, pp. 4.1–4.6.

Acampora et al.; Spectral Reuse in 12 CHZ Satellite Communication Systems, Conference Record, 1977 International Conference on Communications, vol. 3, Jun. 12–15, 1977, pp. 37.5-32–37.5-35.

Bird et al, Multiple-Beam Dual-Offset Reflector Antenna With An Array Feed; Electronic Letters, vol. 14, No. 14, Jul. 6, 1978, pp. 439–441.

*Primary Examiner*—Eli Lieberman

*Attorney, Agent, or Firm*—Erwin W. Pfeifle

[57] ABSTRACT

An offset antenna and feed combination for use in a satellite communication system is disclosed wherein an array of adjacent microwave energy feed elements is disposed within a predetermined shape on the focal surface of the antenna for delivering electromagnetic energy to a remote, correspondingly shaped zone. Electromagnetic energy beams are selectively radiated towards predetermined areas of the overall remote zone by associated cluster groups of feed elements typically arranged as a minimum of one central and six surrounding feed elements. Additionally, each surrounding type of feed element of a cluster may be shared by two or more overlapping clusters, the overlapping clusters generating contiguous beams of electromagnetic energy in different frequency subbands.

12 Claims, 3 Drawing Figures

ARRAY FEED FOR OFFSET SATELLITE ANTENNA

BACKGROUND OF THE INVENTION

1. Field of the Invention

This invention relates to multiple feed microwave antennas, and, more particularly, to array feeds for satellite communication system antennas.

2. Description of the Prior Art

Inadequate communications capacity is perhaps the major problem facing future satellite communication systems. Recently, satellite communication system designs have achieved a dramatic increase in the communication capacity of the satellite by discarding the single beam satellite antenna concept in favor of a multibeam approach. The modern multibeam satellite antenna permits many narrow-angle electromagnetic energy beams to be aimed at separate ground areas within a predetermined zone on the surface of a celestial body from a given aperture. In so doing, a given frequency is reused in many parts of the predetermined zone. Although a larger number of such beams can be accommodated with but a small increase in the total overall weight of the satellite, such a multibeam arrangement requires a high gain antenna. In addition, sidelobe radiation associated with each beam can cause interference between the beams. One prior art antenna which provides sufficient gain and can accommodate many feed elements on its focal surface is disclosed in detail in U.S. Pat. No. 3,914,768, which issued to the present inventor on Oct. 21, 1975.

One prior art solution to the sidelobe interference problem is disclosed in "Spectral Reuse in 12 GHz Satellite Communication Systems" by D. O. Reudink, A. S. Acampora, and Y. S. Yeh, in the *Conference Record,* 1977 *International Conference on Communications,* Volume 3, pp. 37.5-32 to 37.5-35, June 12 to 15, 1977. This reference teaches the use of plural separate narrow beams which are isolated from one another by buffer areas. The use of buffer areas, however, severely limits the number of beams which can be utilized in a given field of view, and produces areas within the predetermined zone on the surface of the celestial body which are not serviced by the satellite. Although such a spot beam approach may adequately serve nodes of heavy traffic origin, a substantial volume of traffic originating in the buffer zone area is left without access to the satellite. One prior art solution to the problem of servicing the buffer area traffic is to provide terrestrial trunking to and from the closest area served by one of the spot beams. The terrestrial backhauling approach, however, entails substantial additional costs. A second solution is to provide a wide angle area coverage antenna port, in addition to the spot beam ports, which will service the buffer areas. This approach suffers from three problems; the first being that the power requirements of this port alone might exceed the power demand of all other ports combined. Secondly, the fact that the wide angle area coverage beam also covers areas serviced by the narrow spot beams results in reception interference at all of the narrow spot beam receiver ground stations. This problem is somewhat alleviated by elaborate wide angle beam shaping techniques which selectively cancel the area coverage beam in the areas served by the narrow spot beams. By the same token, sidelobe radiation from the narrow spot beams interferes with reception at the wide angle area coverage ground stations situated in the buffer area. Finally, since the narrow angle spot beams do not overlap one another, the associated receiving stations on the surface of the celestial body must be situated within the relatively small areas illuminated by such beams, thereby rendering more difficult the tasks of determining the location of spot beam receiver sites and reconfiguring the illumination pattern of the spot beams should traffic requirements change or the satellite be reassigned to a new orbital position in space.

Another prior art solution to the problem of providing area coverage using plural spot beams is disclosed in "Design Tradeoffs for Multibeam Antennas in Communication Satellites," by W. G. Scott, H. S. Luh, and E. W. Matthews in *Conference Record,* 1976 *International Conference on Communications,* Vol. 1, pp. 4.1–4.6, June 14–16, 1976. This reference teaches the use of spot beams, each of which is launched by an associated cluster of plural feed elements. Feed elements may be shared by overlapping clusters, the respective clusters producing beams which are independent of each other because of diverse polarization direction. Thus, the shared feed elements are of a dual polarized type, and capable of down-link transmission throughout the entire electromagnetic energy frequency spectrum of the down-link frequency allocations.

SUMMARY OF THE INVENTION

In accordance with an illustrative embodiment of the invention, the foregoing and other problems of the prior art are solved by providing a communication satellite with a high gain multibeam antenna having a focal surface with many feed elements arranged in clusters disposed therein, wherein overlapping clusters share feed elements and launch respective beams of electromagnetic energy in plural frequency subbands and at one or both orthogonal polarizations to provide discrimination therebetween. Reflectors of the antenna direct the beams to a predetermined zone on the surface of the celestial body.

It is an aspect of the present invention to provide a feed array wherein the number of feed elements and their configuration in each of the cluster groups are advantageously adjustable to achieve desirable beam shapes. A typical beam is launched by a cluster generally containing a minimum of seven feed elements arranged as one central element and six surrounding elements. Sidelobe radiation is reduced in such cluster groups by exciting the surrounding feed elements at a lower power level than the central feed element. Some of the feed elements are shared between overlapping cluster groups which generate contiguous beams, and independence of the beams is maintained by energizing overlapping clusters and their shared elements at diverse frequencies, times or polarization direction.

It is an aspect of an embodiment of the present invention that high communication traffic density areas on the celestial body are served by stationary spot beams typically comprising seven or more grouped feed elements. Areas of lower traffic density are served by area coverage spot beams which are each generated by separate, overlapping clusters of feed elements illustratively containing seven feed elements. Although the stationary spot beams and the area coverage spot beams may each be generated by groups or clusters each containing seven feed elements, the area coverage spot beams have a larger "footprint" on the surface of the celestial body as a result of their contour being defined illustratively, at −7 dB, as opposed to −3 dB for the stationary spot beams. In addition, the area coverage spot beams can be selectively switched on and off on a time division basis, the maximum number of such area coverage spot beams which are simultaneously activated being limited by the available power in the satellite.

Other and further aspects of the present invention will become apparent during the course of the following description and by reference to the accompanying drawings.

BRIEF DESCRIPTION OF THE DRAWING

Referring now to the drawings, in which like numerals represent like parts in several views.

DETAILED DESCRIPTION

Figure 1:
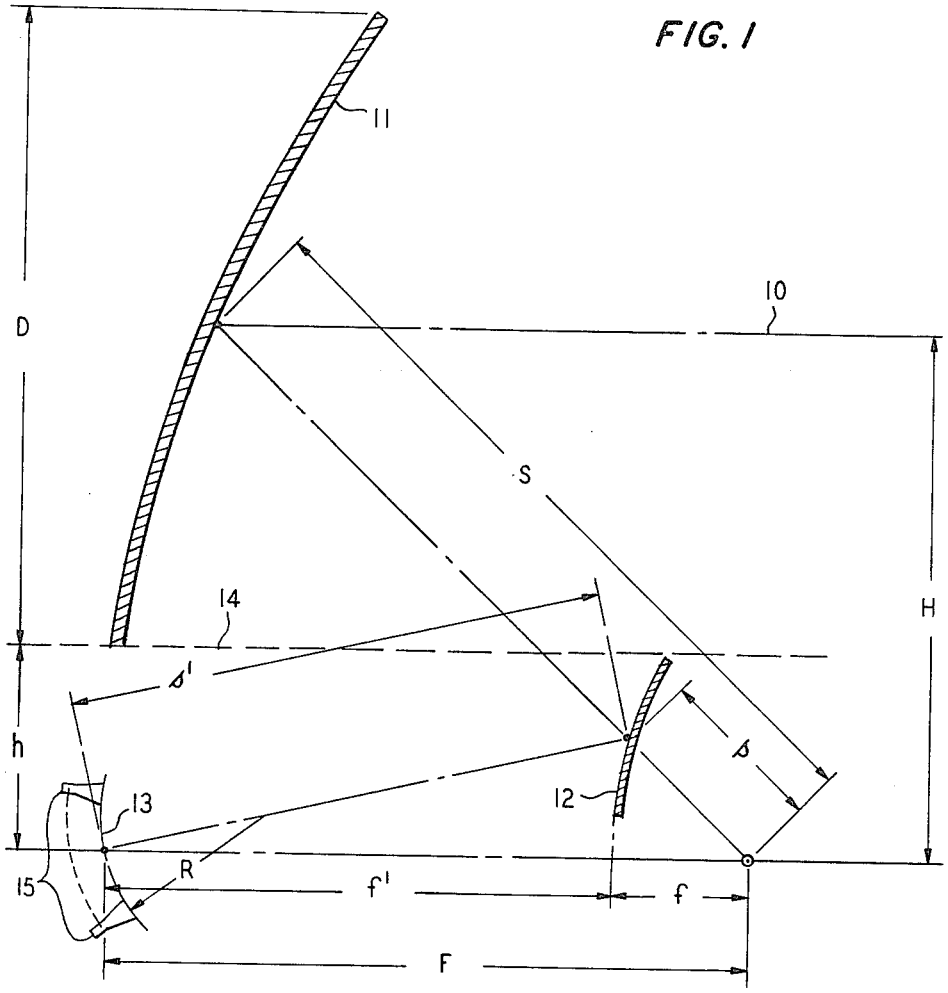
FIG. 1 schematically illustrates the essential geometrical parameters of a prior art offset Cassegranian antenna having plural feed elements.

FIG. 1 is a side view which schematically illustrates the essential elements of a prior art Cassegranian antenna desired to yield efficient multiple beam operation. The antenna is of an offset Cassegranian design, thereby avoiding aperture blockage which is common in symmetrical Cassegranian antennas. The conventional reflective and focal surfaces are positioned asymmetrically with respect to antenna aperture axis 10. This antenna design is characterized by disposing a main reflector 11 entirely on one side of an imaginary plane, shown in this side view as dashed line 14. A subreflector 12 and a focal surface 13 are disposed on the other side of plane 14 from main reflector 11. A plurality of feed horns 15 are disposed on the focal surface, which feedhorns launch electromagnetic energy toward subreflector 12. The energy is reflected by subreflector 12 to main reflector 11 and subsequently to a distant target area, not shown in the figure, within the viewing area of the offset Cassegranian antenna. It is to be understood that reference herein to a Cassegranian antenna is for merely illustrative purposes. Other types of antennas, including configurations which are not offset, can be employed in the practice of the invention.

It is elemental to persons skilled in the antenna art that an antenna capable of supporting a large number of multiple beams must have a large effective focal length (MF) to diameter (D) ratio. A large ratio (i.e. $MF/D \geqq 3$) is achieved by an offset Cassegranian antenna of the type shown in FIG. 1. In one embodiment of the invention where the feedhorns are operated at a frequency of 12 GHz, the antenna parameters shown in FIG. 1 can comprise the following illustrative dimensions:

Table of Antenna Dimensions $F=D=426.72$ cm.
$f'=336.88$
$f=89.84$
$h=133.28$
$H=346.64$
$S=497.12$
$s=109.47$
$s'=356.52$
$R=132.08$ From the above table of illustrative antenna dimensions it can be seen that the focal length F of the main reflector 11 is equal to the aperture diameter D, approximately 4.27 meters. The magnification of subreflector 12 is defined by the formula $M=f'/f$, which in this embodiment equals 3.75. From these basic choices, $MF/D=3.75$ and the parameters S, s, s' can be derived using the basic Cassegranian equations which are found in "Microwave Antennas Derived from the Cassegranian Telescope", by Peter W. Hannon, *IRE Transactions on Antennas and Propagation,* 9, No. 2 (March 1961), pages 140–153.

Figure 2:
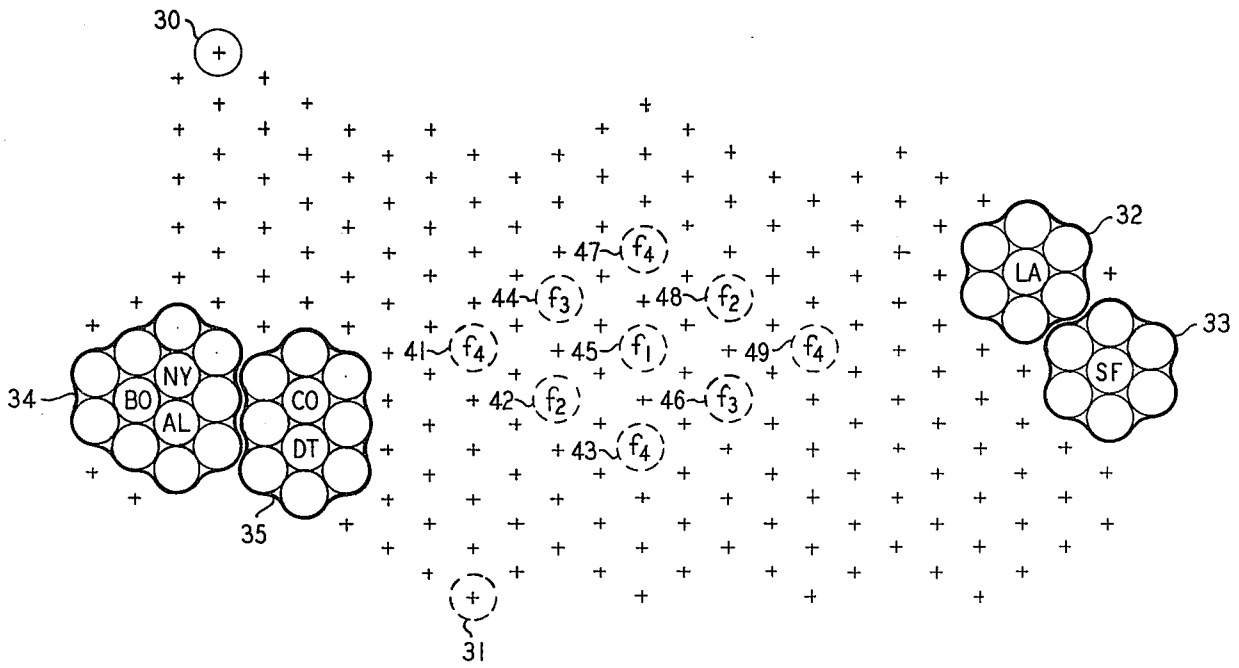
FIG. 2 illustrates a back view of a feed element array disposed on the focal surface of an offset antenna, which array is configured for illuminating the contiguous United States in accordance with the present invention.

FIG. 2 illustrates the back view of an exemplary configuration of the feed element array disposed on focal surface 13 shown in FIG. 1. In FIG. 2, each plus sign (+) identifies one feed element. The exemplary array contains a plurality of feed elements in a configuration 196.7 centimeters wide by 104.8 centimeters tall. Other embodiments may contain different numbers of feed elements in different array configurations. The diameters of the feed beams may be calculated using, for example, the Gaussian-beam equations found in an article entitled "Laser Beams and Resonators", by H. Kogelnik and T. Li, *Applied Optics,* Vol. 5, No. 10 (October 1966), pages 1550–1567. For a seven-element cluster producing one beam, it has been calculated that the −3 dB contour at the focal surface has a diameter of 10.0 centimeters, or approximately 4 wavelengths at 12 GHz. Applying standard Gaussian-beam equations found in the hereinabove mentioned Kogelnik and Li reference, it is found that the seven-element feed cluster is bounded by the −20.5 dB contour at the waist of the feed beam, which contour has a diameter of 26.2 cm. Since the seven-element clusters are each essentially three feed elements in diameter, the contour diameter is divided by three thereby determining that the center-to-center spacing of the individual elements in the seven-element feed clusters is 8.73 centimeters. Applying methods of mathematical analysis known to persons skilled in the art, it is determined that all parts of the contiguous United States can be covered using 218 feed elements in the exemplary feed array as shown in FIG. 2. The overall configuration of the array resembles the shape of the predetermined zone on the surface of the celestial body, which in the exemplary configuration of FIG. 2, is the United States. As a result of image inversion, feed element 30 near the upper left-hand corner of the exemplary array illuminates an area in the southeastern United States, and feed element 31 at the bottom of FIG. 2, illuminates an area in the northern United States. Typical seven feed element groups (32 and 33) for radiating fixed high communication traffic spot beams are shown for Los Angeles and San Francisco, respectively. A 12 element group 34 is shown for covering New York, Boston and Albany, and a 10 element group 35 is shown for covering Chicago and Detroit. It can therefore be seen that individual high traffic city coverage spot beams are formed from advantageously configured numbers of feed elements.

Figure 3:
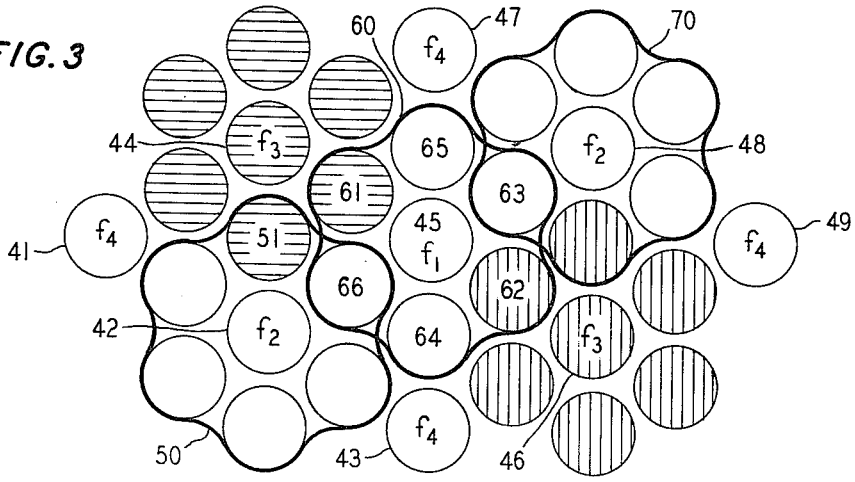
FIG. 3 shows an expanded view of some of the feed clusters shown in FIG. 2, further detailing the possible use of feed elements in more than one cluster group and the distribution of frequency subbands throughout the array.

Areas having low communication traffic volume requirements in the predetermined zone, such as the central portion in FIG. 2, can be covered by a plurality of spot beams produced by a plurality of feed clusters, each cluster being comprised of seven feed elements as will be more clearly understood in the discussion relating to FIG. 3. However, as indicated above, the coverage zones of such area coverage spot beams are defined by −7 dB rather than −3 dB contours, as is the case with the high traffic city coverage spot beams. In accordance with the present invention, the high traffic city spot beams may utilize the full frequency spectrum and may be continuously energized. The low traffic area coverage spot beams, on the other hand, utilize, for example, one-quarter of the available bandwidth each, so as to permit low traffic area coverage spot beams of the same frequency to be more widely separated than high traffic city coverage beams. The frequency spectrum distribution among the low traffic area coverage spot beam is illustrated in the central portion of FIG. 2 wherein nine center elements 41–49 of nine feed clusters for nine respective area coverage spot beams are shown identified by dashed circles. The full frequency spectrum is divided into four subbands denominated $f_1$, $f_2$, $f_3$, and $f_4$. Center feed element 45 in FIG. 2 launches electromagnetic energy within the frequency subband $f_1$ as indicated in the dashed circle. The remaining eight dashed circles each launch electromagnetic energy in respective frequency subbands identified therein. Although only nine center feed elements are shown in FIG. 2, it is to be understood that many more such center feed elements may be distributed throughout the feed element array. Each such feed element will launch energy in a respective one of the four frequency subbands, which frequency subbands are distributed throughout the array in such a manner as to prevent adjacent feed element clusters from operating in the same frequency subbands. For example, center feed element 41 which operated in frequency subband $f_4$ is separated from nearby center feed elements 43 and 47, which also operate in frequency subband $f_4$ by center feed elements 42 and 44 which operate in frequency subbands $f_2$ and $f_3$, respectively.

FIG. 3 illustrates the configuration of plural seven-element feed clusters operating at frequencies $f_1$, $f_2$, $f_3$, and $f_4$, for contiguous low traffic area coverage spot beams. The center feed elements of the shown clusters are identified with the symbols which correspond to those used to identify the center feed elements in the central portion of FIG. 2. In FIG. 3, three clusters 50, 60, and 70, are each shown surrounded by a heavy curving line. Feed element 42 is the center element of cluster 50, feed element 45 is the center element of cluster 60, and feed element 48 is the center element of cluster 70. In addition, feed element 44 is the center element of the cluster of feed elements identified by horizontal stripes, and feed element 46 is the center element of the cluster identified by vertical stripes. The stripes are included to facilitate identification of the clusters of feed elements associated with center feed elements 44 and 46, and are not representative of direction of polarization.

Feed element cluster 60 comprises center feed element 45 operating in frequency subband $f_1$ and surrounding feed elements 61 through 66. Feed element 63 is shown to be shared between cluster 60 and cluster 70 wherein center feed element 48 operates in frequency subband $f_2$. Accordingly, feed element 63 is arranged to enable transmission of electromagnetic energy in both frequency subbands $f_1$ and $f_2$. In similar fashion, feed element 66, which is shared by clusters 60 and 50, is arranged to enable transmission of electromagnetic energy in both frequency subbands $f_1$ and $f_2$. Feed elements 61 and 62 are shared by cluster 60 and respective ones of the horizontally and vertically striped clusters. Each of these feed elements, therefore, launches electromagnetic energy in both frequency subbands $f_1$ and $f_3$. In this embodiment of the invention, none of the shared feed elements operates in more than two frequency subbands. Persons skilled in the art, however, can easily devise arrangements wherein each of the feed elements within a cluster is shared by more than two clusters, and consequently operates in more than two frequency subbands, without departing from the spirit and scope of the invention.

In accordance with the present invention, all low traffic area coverage spot beams might advantageously launch electromagnetic energy of the same polarization direction irrespective of the frequency subband. Such polarization would advantageously be orthogonal to the polarization of high traffic city coverage spot beams. With such arrangements, low traffic area coverage spot beams are isolated from one another by frequency diversification, while low traffic area coverage spot beams are isolated from adjacent high traffic city coverage spot beams by polarization diversification. It is to be further noted that interbeam interference which would result from sidelobe radiation is reduced in such arrangement by energizing the center fee elements of each spot beam to a higher power intensity than the surrounding feed elements within the cluster.

The hereinabove described exemplary embodiment is illustrative of the application of the principles of the invention. It is to be understood that, in light of this teaching, numerous other arrangements may be devised by persons skilled in the art without departing from the spirit and scope of the invention.

I claim:

1. A method of providing satellite communication coverage to a predetermined zone on the surface of a celestial body wherein the predetermined zone comprises a plurality of areas having varying information traffic volume requirements and the satellite includes an antenna arrangement comprising, (a) a main reflector and a subreflector which in combination are capable of reflecting electromagnetic energy between a focal surface of the reflector combination and the predetermined zone, and (b) a feed array comprising a plurality of feed elements disposed on the focal surface of the reflector combination with each feed element being capable of launching electromagnetic energy waves of at least one frequency subband and polarization direction at an associated portion of the predetermined zone, the method comprising the steps of:

(a) selectively energizing clusters of contiguous feed elements of the array for transmitting beams of electromagnetic energy via the reflector combination between the satellite and the associated areas of the predetermined zone characterized in that the method comprises the further steps of:

(b) in performing step (a), selectively energizing overlapping clusters of contiguous feed elements which are associated with low information traffic volume requirements contiguous areas of the predetermined zone for launching respective contiguous beams of electromagnetic energy at a first polarization direction but at different frequency subbands than that of adjacent beams associated with other low information traffic volume areas, each cluster of feed elements sharing at least one feed element with an overlapping cluster of feed elements; and (c) concurrent with step (b), in performing step (a), energizing at least one group of feed elements to produce a contiguous beam of electromagnetic energy at a second polarization direction orthogonal to the first polarization direction, the contiguous beam being directed by the antenna arrangement toward a high information traffic volume requirement area of the predetermined zone.

2. The method of claim 1 characterized in that in performing step (b) each one of the overlapping clusters of contiguous feed elements is capable of launching a beam of electromagnetic energy at a separate one of four predetermined frequency subbands.

3. The method of claim 2 characterized in that the method comprises the further step of (d), concurrent with performing step (b), arranging overlapping feed element clusters which are capable of launching electromagnetic energy beams at respective ones of the frequency subband throughout the array in such a distribution so as to prevent clusters which overlap one another from launching electromagnetic energy in the same frequency subband.

4. The method of claim 3 wherein each cluster of feed elements contains at least one center feed element surrounded by plural adjacent feed elements, characterized in that the method comprises the further step of (e), energizing the center feed element to produce greater output electromagnetic energy power in a given frequency subband than adjacent feed elements within the cluster so as to reduce sidelobe radiation associated with the beam produced by the cluster.

5. The method of claim 1 characterized in that the method comprises the further step of (f), concurrent with performing step (c), energizing the group of feed elements to launch electromagnetic energy in at least two of the frequency subbands employed in performing step (b).

6. The method of claim 5 characterized in that the method comprises the further step of (g), concurrent with performing step (c), arranging the feed elements within the group so as to provide at least one center feed element surrounded by plural adjacent feed elements.

7. The method of claim 6 characterized in that the method comprises the further step of (h), concurrent with performing step (c), energizing the center feed element of the group to produce greater output electromagnetic energy than adjacent feed elements within the group, so as to reduce sidelobe radiation associated with the beam launched by the group.

8. In a satellite communication system of the type wherein a predetermined zone of the surface of a celestial body is illuminated by plural electromagnetic energy beams produced by an array of feed elements disposed on the focal plane of an antenna of a satellite, adjacent ones of which feed elements illuminating respectively associated contiguous areas within the predetermined zone, a method of producing a plurality of contiguous composite beams, each of which composite beams is composed of the combined illumination of a plurality of feed elements and comprises an information transmission channel substantially independent of adjacent such channels, the method characterized by the step of selectively simultaneously energizing overlapping ones of clusters of feed elements of the array, which overlapping clusters share selected ones of the feed elements, each cluster being energized at a preselected one of plural frequency bands and in the same polarization direction as every other cluster, with the plural frequency bands being assigned in multiple directions among the clusters across a portion of the array so as to prevent overlapping clusters from being energized in the same frequency band.

9. In a satellite communication system of the type wherein a predetermined zone on the surface of a celestial body is illuminated by a plurality of electromagnetic energy beams produced by an array of feed elements disposed on the focal plane of an antenna of a satellite, adjacent ones of which feed elements illuminate respectively associated contiguous areas within the predetermined zone, an arrangement for producing a plurality of contiguous composite beams, each of which composite beams is composed of the combined illumination of a cluster of plural feed elements, characterized in that the arrangement comprises means capable of selectively simultaneously energizing overlapping ones of clusters of feed elements of the array, selected ones of which feed elements are shared by selected ones of the clusters, the feed elements in each cluster being energizable to launch a beam of electromagnetic energy in a preselected one of plural frequency subbands and in the same direction of polarization as every other such cluster, the frequency subbands being distributed in multiple directions among the overlapping clusters across a portion of the array so as to prevent feed elements within a cluster which are not shared with a selected overlapping cluster from being energized in the same frequency subband as the selected overlapping cluster.

10. The arrangement of claim 9 characterized in that the arrangement further comprises means capable of energizing each of the overlapping clusters to launch a beam of electromagnetic energy in a respective one of four predetermined frequency subbands.

11. The arrangement of claim 9 or 10 characterized in that the arrangements further comprises means capable of energizing at least one group of the feed elements to produce a contiguous beam of electromagnetic energy at a second polarization direction orthogonal to that of the plural frequency subband beams, the contiguous beam being capable of being directed by the antenna arrangement toward a high information traffic volume area of the predetermined zone.

12. The arrangement of claim 11 characterized in that the arrangement further comprises means capable of energizing the group of feed elements to produce a contiguous beam of electromagnetic energy in two or more of the frequency subbands in which the clusters of feed elements operate.

* * * * *